United States Patent [19]

Febuary

[11] 3,945,415

[45] Mar. 23, 1976

[54] APPAREL VALISE

[76] Inventor: Monty D. Febuary, 17D Kings Lane Road, Greenville, S.C. 29611

[22] Filed: June 16, 1975

[21] Appl. No.: 586,981

[52] U.S. Cl. ..... 150/7; 206/282
[51] Int. Cl.[2] ..... B65D 31/02
[58] Field of Search ..... 150/7; 206/278, 282

[56] References Cited

UNITED STATES PATENTS

| | | | |
|---|---|---|---|
| 1,594,989 | 8/1926 | Auster | 150/7 X |
| 2,087,879 | 7/1937 | Andrews | 206/278 X |
| 2,270,547 | 1/1942 | Nichols | 206/282 X |
| 3,256,976 | 6/1966 | Greason | 206/278 |

*Primary Examiner*—Donald F. Norton
*Attorney, Agent, or Firm*—Bailey & Dority

[57] ABSTRACT

This invention relates generally to an apparel valise for carrying articles of clothing during travel, and more particularly to a valise for packing and carrying shirts. After packing, the valise may be placed in a suitcase or attache case maintaining the shirts in a pressed and wrinkle-free condition therein. The valise includes a substantially rectangular back and a substantially rectangular front section having a medial opening formed therein defining a pair of front side panels on adjacent sides of the opening providing convenient access to the interior of the valise. The front and back sections are joined by expandable side and bottom gusset sections so as to accommodate a plurality of shirts and an upper flat section integral with the back section is provided for covering the open top of the valise. With the flap raised and the side panels folded outwardly, a double opening is provided in said valise for conveniently packing and unpacking shirts therein.

6 Claims, 4 Drawing Figures

APPAREL VALISE

BACKGROUND OF THE INVENTION

Heretofore, general apparel bags have been constructed for carrying articles of clothing. Many attempts have also been made to construct specialized bags for particular articles of clothing such as shown in U.S. Pat. Nos. 2,082,011 and 2,897,865 wherein traveling bags are shown for carrying neckties and socks, respectively.

The problems involved with maintaining shirts in a fresh and unwrinkled condition during travel present particular construction needs for a shirt traveling bag or valise. Special access must be had, which is not usually provided by general apparel bags, so that the shirts can be folded and packed without disturbing the folded configuration. Thereafterwards, the construction of the valise must maintain the shirts in their folded configuration preventing shifting of the shirts therein. The valise must be compact so as to be packable in an associated suitcase or other piece of luggage such as an attache case and must have sufficient rigidity to protect the shirts packed therein against wrinkling due to contact with other heavier articles in the suitcase. It is also necessary to afford protection against moisture and soiling which may be caused by liquid spillage in the associated suitcase, and thus a substantially moisture proof construction is desirable.

SUMMARY OF THE INVENTION

An apparel valise is provided for packing and carrying folded shirts and the like therein comprising a substantially rectangular back section and a substantially rectangular front section having a medial opening formed therein providing convenient access to the interior of the valise and defining a pair of front side panels on adjacent sides of the medial opening.

A closure means is provided for selectively closing the medial opening. A pair of expandable side gusset sections join the front and back sections so as to accommodate a plurality of shirts packed in the valise. An expandable bottom gusset section joins the back and front sections and the pair of side sections providing a closed bottom end for the valise. An open top is defined by the joining of the back and front sections and the pair of side gusset sections at an upper free edge thereof, and an upper flap section integral with said back section extends over the front section providing a cover over the open top of the valise. Thus, a double opening is provided by the open top with the flap raised and by the medial opening with the side panels folded outwardly providing convenient packing and unpacking of said shirts in the valise, whereby shirts packed in the valise are maintained in a fresh and wrinkle-free condition during travel.

Accordingly, an important object of the present invention is to provide a valise for shirts and the like for maintaining the shirts in a fresh and wrinkle-free condition during travel.

Another important object of the present invention is to provide a shirt valise having a double opening access providing convenient packing and unpacking of the shirts therein.

Another important object of the present invention is to provide a shirt valise for maintaining shirts in a fresh condition during travel having sufficient rigidity to afford protection against other heavier objects when packed in an associated suitcase.

Another important object of the present invention is to provide a shirt valise for carrying shirts during travel which protects the shirts against moisture or other liquid spillage in an associated suitcase.

Still another important object of the present invention is to provide a shirt valise for carrying shirts during travel having an interior surface which permits the shirts to slide freely relative thereto reducing the tendency of the shirt fabric to cling against the interior and otherwise disturbing the folded configuration of the shirt.

Yet another important object of the present invention is to provide a shirt valise for carrying folded shirts during travel which is expandable so as to accommodate a plurality of shirts.

BRIEF DESCRIPTION OF THE DRAWING

The construction designed to carry out the invention will be hereinafter described, together with other features thereof.

The invention will be readily understood from a reading of the following specification and by reference to the accompanying drawing forming a part thereof, wherein an example of the invention is shown and wherein.

DESCRIPTION OF A PREFERRED EMBODIMENT

Figure 1:
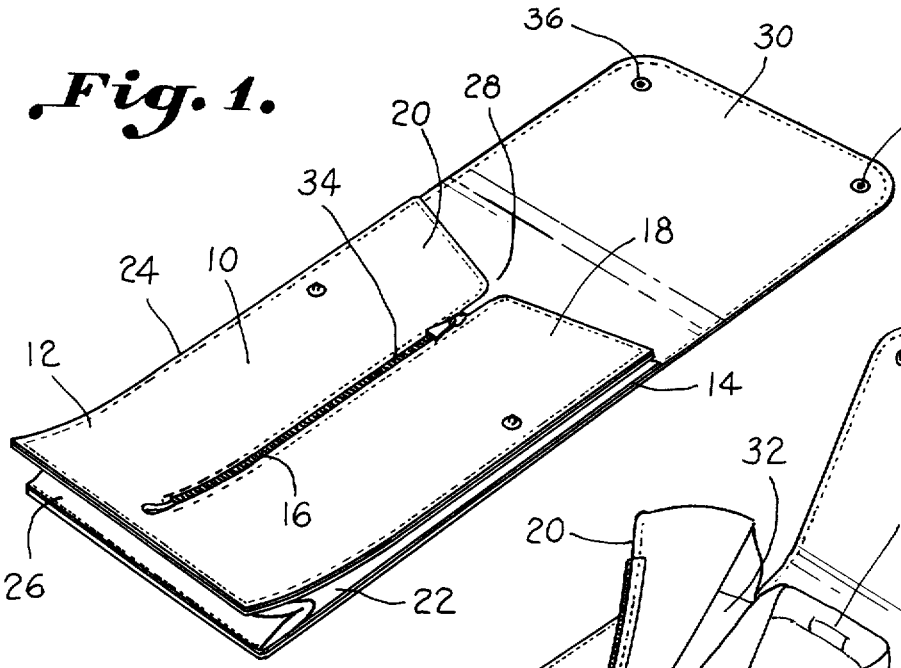
FIG. 1 is a perspective view illustrating a shirt valise constructed in accordance with the present invention.

This invention relates to an apparel valise for carrying shirts during travel which may be used by itself or in combination with an associated suitcase or other luggage, such as an attache case. Essentially, a double opening provides wide open access to the interior of the valise for conveniently packing shirts therein in a neatly folded condition and thereafterwards the valise may be closed so as to maintain the shirts in their folded configuration.

Referring now to the drawing, an apparel valise 10 is illustrated having a substantially rectangular front section 12 and a substantially rectangular back section 14. The front section 12 has a medial opening 16 formed therein defining a pair of front side panels 18 and 20 on adjacent sides of the medial opening providing convenient access to the interior of the valise. A pair of expandable side gusset sections 22 and 24 join the front and back sections 12 and 14, respectively, and an expandable bottom gusset section 26 joins the front and back sections, 12 and 14 and the pair of side sections 24 and 22 providing a closed bottom end for the valise. The expandable side and bottom gusset sections accommodate a plurality of shirts depending upon how the shirts are folded. The expandable valise will hold approximately one to five shirts which have been professionally laundry folded.

Figure 2:
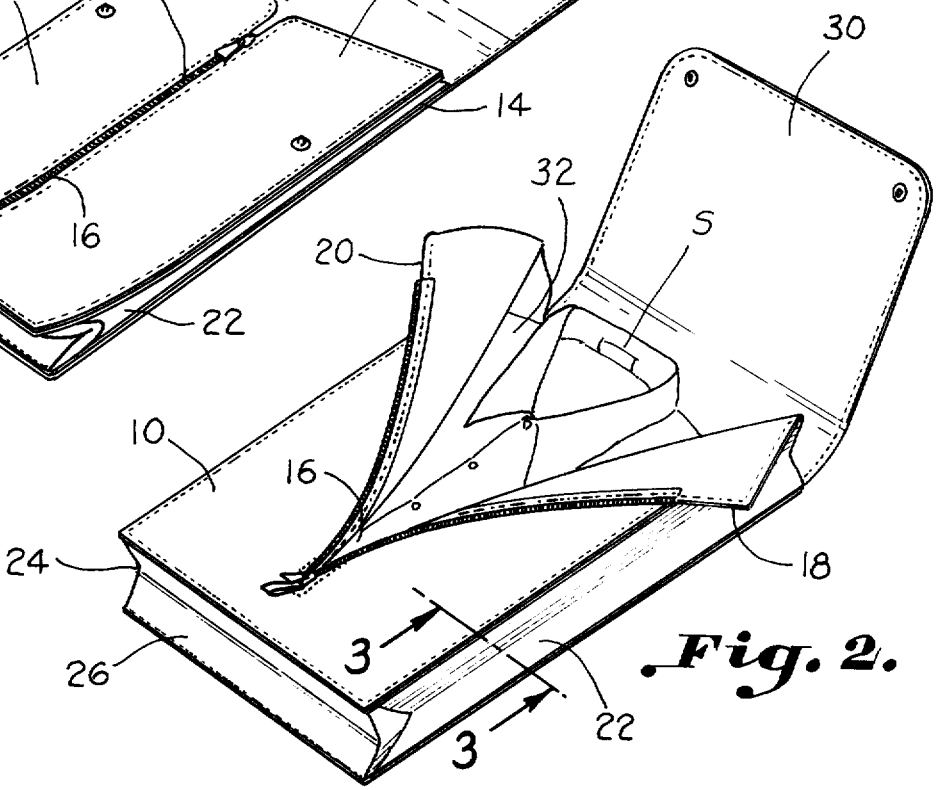
FIG. 2 is a perspective view illustrating a shirt packed in an apparel valise constructed in accordance with the present invention wherein a double opening is provided for convenient access to the valise interior.

An open top 28 is defined by the joining of the front section 12, the back section 14, and the pair of side gusset sections 22 and 24 at an upper free edge thereof. An upper flat section 30 integral with the back section 14 extends over the front section 12 providing a cover over the open top 28 of the valise. Thus, it can be seen that when the open top 28 is uncovered by raising the flap 30 and when the medial opening 16 is spread apart with the side panels 18 and 20 folded outwardly therefrom, as best seen in FIG. 2, a double opening 32 is essentially provided whereby shirts may be conveniently placed in the valise interior without disturbing their neatly folded configuration while also providing convenient unpacking of the shirts. Once the shirts have been placed within the valise, the medial opening 16 may be closed by providing a zipper 34 or any other suitable closure means may be provided, and the upper flap 30 is folded over the top of the bag and fastened to the front section 14 by any suitable fastening means such as snaps 36 and 38. Once the valise is closed the shirts packed therein are maintained in a fresh and wrinkle-free condition during travel due to the advantageous construction of the shirt valise as will be more fully described.

Figure 3:
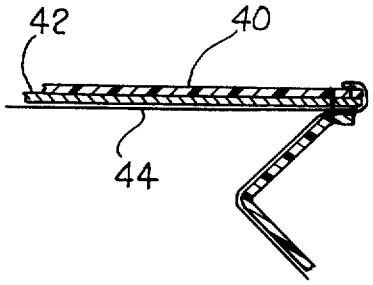
FIG. 3 is a sectional view taken along line 3—3 of FIG. 2.

Each of the front section 12, back section 14, and upper flap section 30 have a three-layer construction as can best be seen in FIG. 3. Each section includes an outer layer 40 which is preferably a heavy vinyl material. The next layer adjacent the material 40 is stiffening member 42 which may be any suitable stiffener such as a cardboard or pressboard member which affords rigidity to the above mentioned sections. Adjacent the stiffening member 42 and forming the interior surface of the bag is a layer of material 44 which preferably is a lightweight vinyl material being of approximately half the weight of the outer vinyl material 40 for protecting the shirts packed therein against moisture and elminating clinging of the shirt fabric which would otherwise occur against the cardboard member 42. The vinyl interior surface 44 also provides a surface over which the shirts will slide when being placed within the valise without disturbing their folded configuration. The vinyl interior will also allow some sliding of the shirts relative to the interior surface when the bag is closed and folded, however, such will not wrinkle the shirts as would a surface interior in which the shirts would cling. The vinyl construction also affords protection for the shirts against any liquid spillage that might occur when the valise is packed in an associated suitcase with containers carrying liquid. The upper flap section 30 and the back section 14 may be formed as a one-piece construction having the three layers described above.

With the shirt, or shirts neatly folded and packed within the valise 10, with the medial opening 16 closed, and the flap 30 folded over the front section and attached thereto, the shirts will be maintained in a fresh and wrinkle-free condition by the substantially rigid front and back sections 12 and 14 and the flap section 30. The added weight of the stiffening member 42 formed within the front, back, and flap sections as described above will be sufficient to press the shirts slightly together between the front and back sections 12 and 14 so as to hold them in place in the valise. The substantially rigid construction of the front, back and flap sections also protects the shirts packed within the valise against heavier objects which might also be contained in an associated suitcase when the valise is packed therein. The shirts are slightly compressed together between the sitffened front and back sections so as to maintain them neatly pressed.

Figure 4:
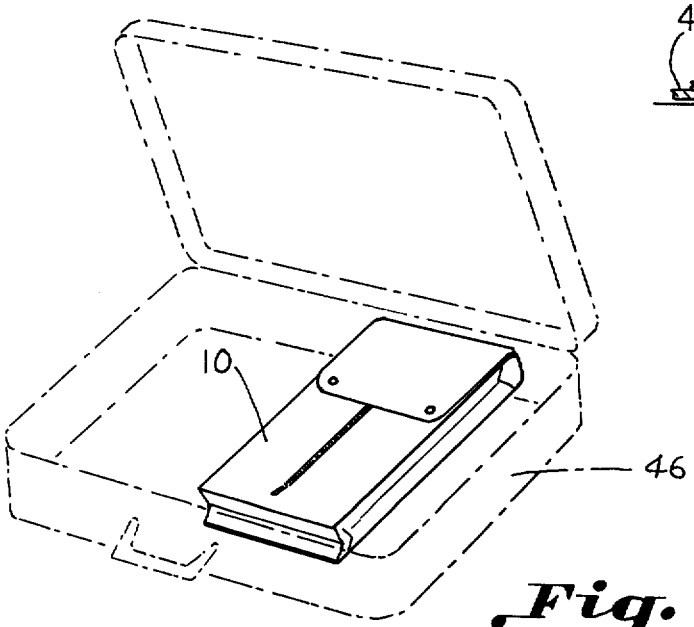
FIG. 4 is a perspective view illustrating a shirt valise constructed in accordance with the present invention packed in an associated suitcase.

FIG. 4 illustrates the shirt valise 10 constructed in accordance with the present invention and packed in an associated suitcase 46. Compact construction of the shirt valise in accordance with the present invention allows the valise to be used either alone for carrying shirts or allows the valise to be packed in an associated suitcase or other luggage such as an attache case. The valise constructed in accordance with the present invention provides a variety of uses such as carrying only a single shirt and packed in an attache case for an overnight business trip or the bag may be packed to hold a plurality of shirts in a larger suitcase for extended periods of travel. Preferably, the bag is constructed so as to expand from approximately 1 to 4 inches to accommodate a plurality of shirts depending on how they are folded. However, it is to be understood that such a bag could be made to expand to accommodate a larger number of shirts if desired. The preferred construction however, permits the bag to be used for a single shirt without being bulky or overly large, as well as a plurality of shirts.

Thus, it can be seen that an effective shirt valise can be had when constructed in accordance with the present invention providing wide open access to the interior of the bag for placing the shirts therein in a neatly folded configuration without disturbing such while maintaining the shirts in an unsoiled, fresh and wrinkle-free condition thereafter once the valise opening is closed. The valise constructed in accordance with the present invention when packed in an associated suitcase affords protection for the shirts packed therein against heavier objects and liquid spillage in the associated suitcase.

While a preferred embodiment of the invention has been described using specific terms, such description is for illustrative purposes only, and it is to be understood that changes and variations may be made without departing from the spirit or scope of the following claims.

What is claimed is:

1. An apparel valise for packing and carrying folded shirts and the like therein comprising:

a substantially rectangular back section;

a substantially rectangular front section;

a medial opening formed in said front section providing convenient access to the interior of said valise, said medial opening defining a pair of front side panels on adjacent sides of said medial opening;

closure means for selectively closing said medial opening;

a pair of expandable side gusset sections joining said front and back sections so as to accommodate a plurality of shirts packed in said valise;

an expandable bottom gusset section joining said back and front sections and said pair of side sections providing a closed bottom end for said valise;

an open top defined by the joining of said of back and front sections and said pair of side gusset sections at an upper free edge thereof;

an upper flap section integral with said back section extending over said front section providing a cover over said open top of said valise; and a double opening provided by said open top with said flap raised and said medial opening with said side panels folded outwardly providing convenient packing and unpacking of said shirts in said valise;

whereby shirts packed in said valise are maintained in a fresh and wrinkle-free condition during travel.

2. The valise of claim 1 wherein said front and back sections include an outer vinyl member, an inner lightweight vinyl member, and a stiffener member carried therebetween affording rigidity to said valise for protecting the shirts packed therein while said inner vinyl member protects the shirts from moisture while eliminating cling of shirt fabric to said stiffener member.

3. The valise of claim 2 wherein said upper flap section includes fastening means for attaching said flap section to said front section.

4. The valise of claim 1 wherein said pair of side gusset sections and said bottom gusset section expand from approximately one inch to five inches to accommodate a plurality of shirts packed therein.

5. The valise of claim 1 wherein said medial opening extends from the upper free edge of said front section to adjacent the bottom thereof.

6. The valise of claim 5 wherein said closure means is a zipper.

* * * * *